US005720351A

United States Patent [19]

Beukema et al.

[11] Patent Number: 5,720,351

[45] Date of Patent: Feb. 24, 1998

[54] FIRE PROTECTION PREACTION AND DELUGE CONTROL ARRANGEMENTS

[75] Inventors: John A. Beukema, Somers, N.Y.; Thomas L. Multer, Lilburn, Ga.

[73] Assignee: The Reliable Automatic Sprinkler Co., Mount Vernon, N.Y.

[21] Appl. No.: 739,552

[22] Filed: Oct. 30, 1996

[51] Int. Cl.[6] ..... A62C 35/62

[52] U.S. Cl. ..... 169/61; 169/16; 169/17; 169/18; 169/19

[58] Field of Search ..... 169/5, 16, 17, 169/19, 18, 61

[56] References Cited

U.S. PATENT DOCUMENTS 2,342,589 2/1944 Lewis ..... 169/19
4,356,870 11/1982 Gaylord et al. ..... 169/65

OTHER PUBLICATIONS

Reliable®, The Reliable Automatic Sprinkler Co., Inc., Bulletin 501R, Models B and BX Deluge Valves, Jan. 1996, Instructions for Installation, Operation, Care and Maintenance, "4" and 6" Sizes Wet Pilot Line, Dry Pilot Line, Electric Actuation".

Reliable®, The Reliable Automatic Sprinkler Co., Inc., Bulletin 503H, Model A Deluge Valve, Nov. 1995, Instructions for Installation, Operation, Care and Maintenance, "2½" Wet Pilot Line, Dry Pilot Line, Electric Actuation".

Reliable®, The Reliable Automatic Sprinkler Co., Inc., Bulletin 714B, Supertrol Double Interlock Preaction System 4 and 6 Inch, Jan. 1996, Instructions for Installation, Operation, Care and Maintenance, "Electric Pneumatic Double Interlock Preaction Systems Controlled by a Cross-Zoned Releasing Control Panel Type D System: 7 to 10 psi Pneumatic Pressure".

Reliable®, The Reliable Automatic Sprinkler Co., Inc., Bulletin 715, Supertrol Single Interlock Preaction System 2½ Inch, Jan. 1996, Instructions for Installation, Operation, Care and Maintenance, "For Single Interlock Preaction Systems with Electric Actuation".

Reliable®, The Reliable Automatic Sprinkler Co., Inc., Bulletin 716, Supertrol Single Interlock Preaction System 4 and 6 Inch, Mar. 1996, Instructions for Installation, Operation, Care and Maintenance, "For Single Interlock Preaction Systems with Electric Actuation".

Reliable®, The Reliable Automatic Sprinkler Co., Inc., Bulletin 713, Supertrol Double Interlock Preaction System 2½" Size, Jan. 1996, Instructions for Installation, Operation, Care and Maintenance, "Electric Pneumatic Double Interlock Preaction Systems Controlled by a Cross-Zoned Releasing Control Panel Type D System: 7 to 10 psi Pneumatic Pressure".

Grinnell Corporation, Duomatic™ Dry Systems, 4 and 6 Inch, Dec. 1989, TD1150.

Grinnell Corporation, Preaction System, Double Interlock, Electric/Pneumatic Release, Model F445—2-½ Inch (65mm), Jan. 1996, TD1146.

(List continued on next page.)

*Primary Examiner*—Gary C. Hoge
*Attorney, Agent, or Firm*—Baker & Botts, L.L.P.

[57] ABSTRACT

In the embodiments described in the specification, a deluge and preaction control system supplies water to a sprinkler line through a solenoid control valve which may be actuated by a control panel receiving electrical signals from detectors or from an emergency switch. A preaction riser assembly is arranged to bypass the solenoid control valve to supply water to the sprinkler line through a manual valve and to permit testing of the system. An optional compressor supplying air pressure of at least 2 psi to the sprinkler line and detects damage to the sprinkler line by loss of pressure.

8 Claims, 1 Drawing Sheet

OTHER PUBLICATIONS

Grinnell Corporation, Deluge Valve, Automatic Resetting, 2-½ Inch (65mm) Model F446 (Thread×Thread or Groove× Groove)—250 Psi (17,2 bar), Jan. 1996, TD114M.

Grinnell Corporation, Special System Water Control Valves—2 & 2-½ Inch Model F460 PRIMAC®, Dec. 1989, TD175.

Grinnell Corporation, Deluge Valve, External Resetting, Model F470 MULTIMAC®—4 and 6 Inch (100 and 150 mm), Oct. 1994, TD116.

STAR Sprinkler Corporation, Model "G" 3 Inch and 6 Inch Hidromatic Deluge Valves.

STAR Sprinkler Corporation, Product Data: Model "A" Double Interlocked Valve, Nov. 1989.

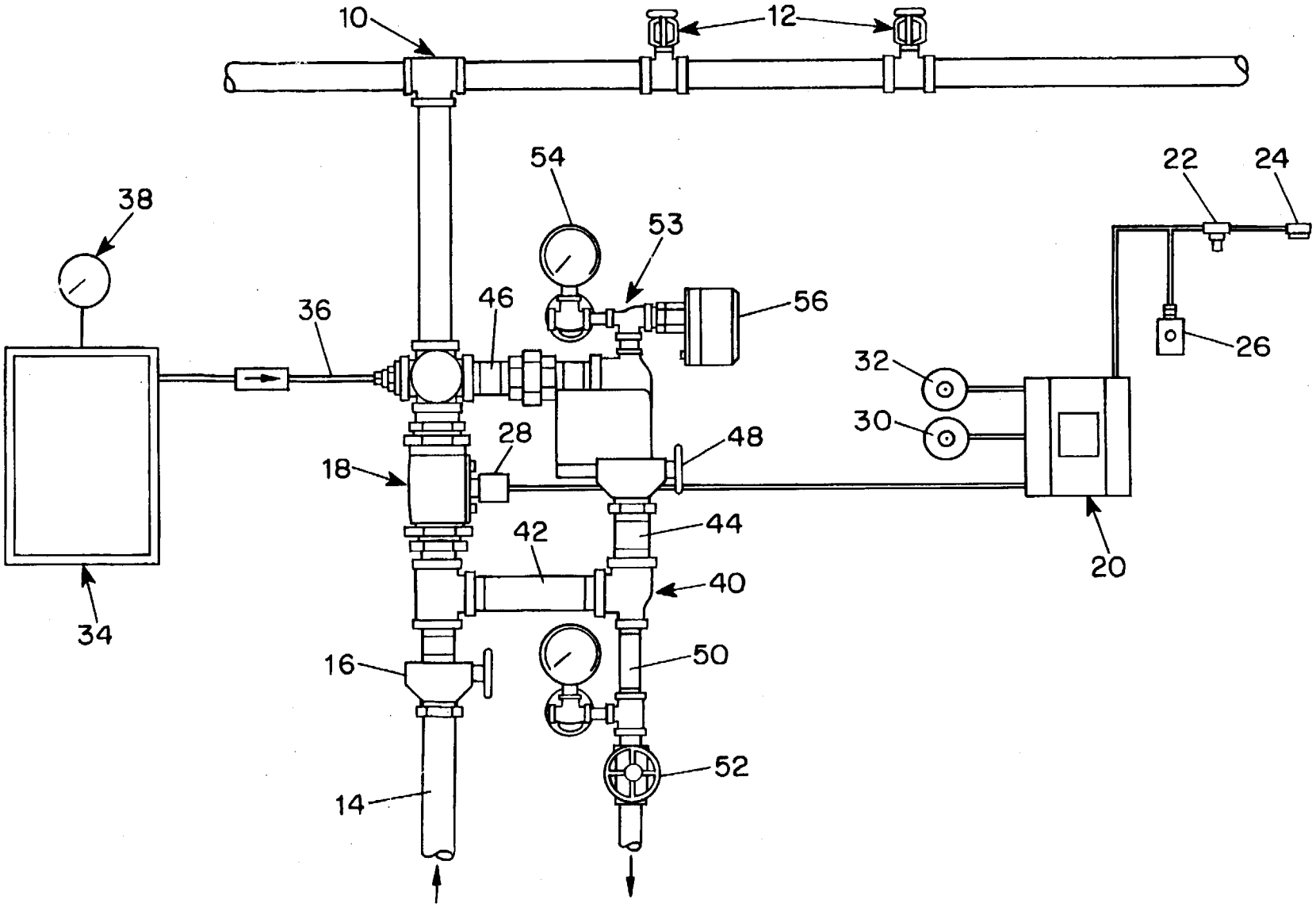
24
22
26
20
32
30
12
56
53
48
44
40
50
52
54
42
46
28
10
36
18
16
14
38
34

FIRE PROTECTION PREACTION AND DELUGE CONTROL ARRANGEMENTS

BACKGROUND OF THE INVENTION

This invention relates to fire protection systems having a control valve to control the supply of water to a sprinkler line in response to detection of a fire hazard.

Conventional deluge and preaction fire protection systems include a control valve, commonly called a deluge valve, which normally prevents water from flowing into a sprinkler line. In conventional systems, the control valve is maintained in the closed condition by hydraulic pressure in a pilot line which is released when a fire hazard is detected by operation of a manually opened valve or a thermally activated sprinkler on a hydraulic pilot line or by a pneumatic pilot line actuator valve or an electrically activated solenoid valve in the pilot line. The control valve is released to supply a fire extinguishing agent, such as water, into the sprinkler line by releasing the hydraulic pressure which maintains the deluge valve in the closed condition.

In deluge systems, large quantities of water are supplied to normally open sprinklers or nozzles in sprinkler pipe lines which have no thermal sensing capability. On the other hand, preaction systems utilize closed sprinklers or nozzles having an integral thermal sensor and are designed to protect areas that are highly sensitive to collateral water damage. Preaction systems are pressurized with relatively low pneumatic pressure which permits the integrity of the sprinkler pipe lines to be monitored. In the event there is a break in a line or a sprinkler an alarm is set off but water is not automatically and accidentally supplied through the line as would occur in systems controlled by a wet pipe (alarm check) valve or a dry pipe valve. Furthermore, preaction systems usually require a check valve at the discharge of the control valve to prevent the loss of supervisory air pressure which could be vented through the control valve causing a false alarm.

Conventional preaction systems are relatively complex and expensive, tending to preclude the benefits of their use in low cost water-sensitive applications such as small areas and residential applications where the need to avoid inadvertent water damage is as important as providing protection against fire damage.

SUMMARY OF THE INVENTION

Accordingly, it is an object of the present invention to provide an arrangement for controlling deluge and preaction systems which avoids the disadvantages of the prior art.

Another object of the invention is to provide an arrangement for controlling deluge and preaction fire protection system which is simple and inexpensive while at the same time providing all of the advantages of conventional systems.

These and other objects of the invention are attained by providing a deluge or preaction fire protection system which includes a solenoid control valve responsive to electrical detection of fire hazard conditions. In this way, the expense and complexity of pilot line installations can be avoided and, if desired, damage to the sprinkler system can be detected by loss of pneumatic pressure to set off an alarm without releasing water into the system.

BRIEF DESCRIPTION OF THE DRAWING

Further objects and advantages of the invention will be apparent from a reading of the following description in conjunction with the accompanying drawing which is a schematic, diagrammatic view illustrating the arrangement of a representative embodiment of a sprinkler system having a preaction detector and solenoid control valve.

DESCRIPTION OF PREFERRED EMBODIMENTS

In the typical arrangement illustrated in the accompanying drawing, a fire protection sprinkler system includes a sprinkler line 10 in which a plurality of sprinklers 12 are mounted and positioned to spray fire extinguishing fluid, such as water, over a region to be protected from fire. The sprinkler line 10 is connected to a water supply line 14 through a manual isolating valve 16 and a solenoid control valve 18. A control panel 20 is arranged to receive signals from a plurality of detectors 22 and 24 and from a manual emergency switch 26 and to supply control signals to a solenoid 28 in the solenoid control valve 18 and to a trouble alarm bell 30 and a fire alarm bell 32 in accordance with the detected signals. In addition, an air compressor 34 is optionally connected through a line 36 to the sprinkler line 10 to supply air pressure thereto to permit detection of any damage to the system and includes an alarm 38 activated by loss of pressure in the sprinkler line 10. Alternatively, a supply of any suitable gas under pressure may be used in place of the air compressor.

In addition, a preaction riser assembly 40 includes three lines 42, 44 and 46 connected between the water supply line 14 and the sprinkler line 10 so as to bypass the solenoid control valve 18 and a manual emergency valve 48 in the line 44 which is normally maintained in the closed position. Another line 50 connected to the line 44 and having a manual valve 52 which is normally kept closed is provided to permit water to be drained from the sprinkler line 10 and the riser assembly 40 when the isolating valve 16 is closed. A water flow detector 53 including a pressure gauge 54 and a water flow alarm pressure switch 56 is connected in the riser assembly between the lines 44 and 46.

In operation, water is supplied under pressure to the line 14 and the isolating valve 16 is opened while the manual emergency valve 48 and the drain valve 52 are closed. In the absence of an actuating signal from the control panel 20, the solenoid control valve 18 is kept in the closed position and consequently there is no water in the sprinkler line 10.

If the optional air compressor which supplies air for sprinkler line damage detection is provided, air is supplied from the compressor 34 through the line 36 to the sprinkler line 10 at a pressure of at least 2 psi. If damage is inflicted on the sprinkler line by breaking of a pipe or a sprinkler, the alarm 38 will be set off signalling the necessity for repairing the sprinkler line. In this way, there will not be any accidental water flow damage to objects in the region to be protected resulting from sprinkler line damage, which would occur in systems having no preaction arrangement.

In the event of a fire, one or more of the detectors 22 and 24, which may be heat and smoke detectors respectively, for example, is actuated, or the emergency switch 26 is operated manually to send a control signal to the control panel 20 which in turn sends an actuating signal to the solenoid 28 controlling the solenoid control valve 18 so as to open the valve and fill the sprinkler line 10 with water, at the same time actuating the fire alarm bell 32. Consequently, if one of the sprinklers 12 is thereafter actuated by release of its thermally-responsive element, water is immediately sprayed over the region to be protected without the delay which would otherwise occur if the sprinkler line 10 were empty.

If there is no fire or condition causing a sprinkler 12 to be actuated and there is no longer any danger of fire, the sprinkler line 10 can be drained by closing the isolating valve 16 and opening the valves 48 and 52 and restoring the system to its normal condition.

If desired, the control panel 20 may be set to require signals from at least one smoke detector 22 and one heat detector 24 before actuating the solenoid 28 of the solenoid control valve 18. The trouble alarm bell 30 is set off when electrical systems supervision detects a fault in the wiring to the detector or the solenoid control valve 18 or when the isolating valve 16 is inadvertently closed, partially or fully. The signal at the control panel will enable the cause of the signal to be determined and corrected before the solenoid control valve is required by a fire condition to release water into the sprinkler line. Alternatively, the control panel may be set to require two or more heat detectors to two or more smoke detectors to supply signals before causing the solenoid control valve to be opened.

For deluge systems which have permanently open sprinklers or nozzles 12, the compressor panel 34 and air line 36 are omitted and water is sprayed over the region to be protected as soon as the solenoid control valve 18 is opened.

With the deluge and preaction system described herein, the necessity for a complex riser assembly connected to pilot lines to operate the control valve is eliminated, thereby providing significant cost savings and making the system convenient and inexpensive enough for residential applications, for example. In addition, the arrangement eliminates the necessity for a check valve at the outlet of the control valve which is usually required to prevent loss of air pressure venting through the control valve. Moreover, by providing a manual release emergency valve 48 in the preaction riser assembly, the system can be operated manually without requiring operation of the control valve which is necessary in conventional systems.

Although the invention has been described herein with reference to specific embodiments, many modifications and variations therein will readily occur to those skilled in art. Accordingly, all such variations and modifications are included within the intended scope of the invention.

We claim:

1. A fire protection sprinkler system comprising:

a sprinkler line including a plurality of normally closed sprinklers for distributing fire extinguishing fluid received from the sprinkler line to a region to be protected;

a thermally responsive element in each of the sprinklers for normally maintaining the corresponding sprinkler in the closed condition but responsive to elevated temperatures to open the sprinkler;

a source of fire extinguishing fluid under pressure;

a solenoid control valve connecting the source of fire extinguishing fluid under pressure directly to the sprinkler line; and at least one detector for detecting incipient fire conditions in the region to be protected and supplying an electrical signal in response thereto for use in actuating the solenoid control valve.

2. A fire protection sprinkler system according to claim 1, including compressed gas supply means for supplying gas under pressure to the sprinkler line and for detecting damage to the sprinkler line by loss of gas pressure therein.

3. A fire protection sprinkler system according to claim 1, including a riser assembly bypassing the solenoid control valve having a manual emergency actuation valve to permit water under pressure to be supplied to the sprinkler line and including a drain valve for draining the sprinkler line.

4. A fire protection sprinkler system comprising:

a sprinkler line including at least one sprinkler for distributing fire extinguishing fluid to a region to be protected;

a source of fire extinguishing fluid under pressure;

a solenoid control valve connecting the source of fire extinguishing fluid under pressure directly to the sprinkler line; and at least one detector for detecting incipient fire conditions in the region to be protected and supplying an electrical signal in response thereto for use in actuating the solenoid control valve, including a riser assembly bypassing the solenoid control valve having a manual emergency actuation valve to permit water under pressure to be supplied to the sprinkler line and including a drain valve for draining the sprinkler line, wherein the riser assembly includes a water flow alarm pressure switch for indicating water flow through the riser assembly.

5. A fire protection sprinkler system comprising:

a sprinkler line including at least one sprinkler for distributing fire extinguishing fluid to a region to be protected;

a source of fire extinguishing fluid under pressure;

a solenoid control valve connecting the source of fire extinguishing fluid under pressure directly to the sprinkler line;

a plurality of detectors for detecting incipient fire hazard conditions in the region to be protected and supplying electrical signals to a control means; and control means responsive to receipt of at least two signals from the detectors to actuate the solenoid control valve.

6. A fire protection sprinkler system according to claim 5, including alarm means actuatable by the control means for setting off an alarm to indicate receipt of a signal from a single detector in the region to be protected.

7. A fire protection control system according to claim 1, wherein the sprinklers in the sprinkler line include a thermally responsive element normally maintaining the sprinkler in the closed condition.

8. A fire protection sprinkler system according to claim 1, wherein the sprinklers in the sprinkler line are normally open so as to distribute fire extinguishing fluid whenever it is supplied to the sprinkler line.

* * * * *